US008944104B2

(12) United States Patent
Kauss et al.

(10) Patent No.: US 8,944,104 B2
(45) Date of Patent: Feb. 3, 2015

(54) HYDRAULIC PILOT CONTROL UNIT

(75) Inventors: Wolfgang Kauss, Francheville (FR); Gerard Laroze, Mions (FR)

(73) Assignee: Robert Bosch GmbH, Stuttgart (DE)

( * ) Notice: Subject to any disclaimer, the term of this patent is extended or adjusted under 35 U.S.C. 154(b) by 267 days.

(21) Appl. No.: 13/575,280

(22) PCT Filed: Dec. 22, 2010

(86) PCT No.: PCT/EP2010/007886

§ 371 (c)(1),
(2), (4) Date: Oct. 8, 2012

(87) PCT Pub. No.: WO2011/091837

PCT Pub. Date: Aug. 4, 2011

(65) Prior Publication Data

US 2013/0042930 A1 Feb. 21, 2013

(30) Foreign Application Priority Data

Jan. 29, 2010 (DE) ..... 10 2010 006 196

(51) Int. Cl.
*F15B 13/02* (2006.01)
*F15B 13/042* (2006.01)

(52) U.S. Cl.
CPC ..... *F15B 13/0422* (2013.01)
USPC ..... 137/636.1

(58) Field of Classification Search
USPC ..... 137/636.1, 636.2, 625.68
See application file for complete search history.

(56) References Cited

U.S. PATENT DOCUMENTS

| | | | | |
|---|---|---|---|---|
| 4,296,773 | A | 10/1981 | Harshman et al. | |
| 4,341,243 | A | 7/1982 | Melocik | |
| 5,433,249 | A * | 7/1995 | Tsubota et al. | 137/625.68 |
| 6,932,113 | B1 * | 8/2005 | Kauss | 137/636.2 |
| 8,490,654 | B2 * | 7/2013 | Hoppe et al. | 137/625.68 |

FOREIGN PATENT DOCUMENTS

| | | | |
|---|---|---|---|
| DE | 196 22 948 | A1 | 12/1997 |
| DE | 103 24 051 | A1 | 12/2004 |
| EP | 0 757 198 | A1 | 2/1997 |
| EP | 0 943 814 | A2 | 9/1999 |
| FR | 2 857 705 | A1 | 1/2005 |

OTHER PUBLICATIONS

International Search Report corresponding to PCT Application No. PCT/EP2010/007886, mailed May 4, 2011 (German and English language document) (7 pages).

* cited by examiner

*Primary Examiner* — Kevin Lee
(74) *Attorney, Agent, or Firm* — Maginot, Moore & Beck LLP

(57) ABSTRACT

A hydraulic pilot control unit includes at least one pressure control valve that can be controlled by means of an actuating device. The pressure control valve includes a control piston connected to a stem by means of a neck. The stem has a resilient operative connection to the actuating device. The neck is fastened to the stem. Thus, the mass of the control piston, which tends to oscillate, is reduced compared to the prior art.

11 Claims, 2 Drawing Sheets

HYDRAULIC PILOT CONTROL UNIT

This application is a 35 U.S.C. §371 National Stage Application of PCT/EP2010/007886, filed on Dec. 22, 2010 which claims the benefit of priority to Serial No. DE 10 2010 006 196.4, filed on Jan. 29, 2010 in Germany, the disclosures of which are incorporated herein by reference in their entirety.

The present disclosure relates to a hydraulic pilot control unit as described herein.

BACKGROUND

Such hydraulic pilot control units having pressure-regulating valves serve, in particular, for pressurizing and therefore adjusting valve spools of valves or main stages, which are subjected to relatively high pressure forces. For this purpose the pilot control units comprise joysticks or handles, which serve for adjusting the respective control pistons of the pressure-regulating valves.

DE 196 22 948 A1 shows a pressure-regulating valve of such a hydraulic pilot control unit. Here (according to FIG. 1) a control pressure present acting on the connection P is transmitted wholly or partially to a working connection A, when a control piston is displaced in an opening direction by a tappet.

One disadvantage to such hydraulic pilot control units is that oscillations can be induced in the control piston here by pressure acting on various surfaces and by various springs. This is exacerbated by the fact that the control piston is composed of iron and thereby has a relatively large mass. Furthermore, the inducement of oscillations is exacerbated in that the control piston has a relatively long neck, via which a main portion of the control piston is connected to the tappet.

DE 103 24 051 A1 shows a pressure-reducing valve, the control piston of which, embodied as a stepped piston, is relatively heavily damped. For this purpose a damping passage is provided with a damping pin. This increases the stability of the feedback loop, but at the same time also presents disadvantages, such as a slower response speed, for example.

A further possible way of increasing the stability is to reduce the gain of the feedback loop in accordance with FR 2 857 705 B1.

In the light of this, the object of the disclosure is to create a hydraulic pilot control unit having at least one pressure-regulating valve, in which the stability of the feedback loop is increased through a directly acting parameter.

This object is achieved by a hydraulic pilot control unit having the features described herein.

SUMMARY

The hydraulic pilot control unit according to the disclosure has at least one pressure-regulating valve, which can be controlled by way of an actuating device and which comprises a control piston connected to a tappet by way of a neck. Here the tappet is operatively connected to the actuating device. According to the disclosure the neck is fixed to the tappet. This serves to reduce the mass of the control piston susceptible to oscillations, as compared to the state of the art. A directly acting parameter of the feedback loop of the pressure regulating valve is therefore modified in such a way that the inducement of oscillations in the control piston is reduced. This also serves, for example, to reduce the noise generated by the hydraulic pilot control unit according to the disclosure.

Further advantageous developments of the disclosure are described herein.

In an especially preferred development each control piston is composed substantially of aluminum or plastic. This further reduces its mass and hence the inducement of oscillations, compared to steel.

In an especially preferred development each tappet and the associated control piston can be displaced by the actuating device in an opening direction of the control piston. In this case a shear-elastic connection is provided between each neck and the associated control piston.

The shear-elastic connection is preferably formed by a regulating spring and by a head, fixed to an end portion of the neck and inserted into a recess arranged on a first end portion of the control piston. The regulating spring here is supported against the tappet and biases the control piston in an opening direction. The head is received in the recess in opposition to the force of the regulating spring, so that it is displaceable in an opening direction. This allows for the possibility of a jump in pressure on a working connection of the associated pressure-regulating valve during a first part of an adjustment travel of the operating unit or the tappet.

It is especially preferred if each head can be brought into bearing contact with an end face of the recess when the associated tappet is displaced in an opening direction. Beyond a predefined differential between a regulating spring force and pressure forces acting in opposition, this affords a direct or unsprung displacement of the control piston in an opening direction, resulting in a jump in pressure on the working connection.

In an especially preferred development each pressure-regulating valve has a return spring, which is supported against a housing of the pilot control unit or of the associated pressure-regulating valve, and which biases the tappet in a closing direction. A force acting in a closing direction of the pressure-regulating valve is thereby generated in opposition to a manual force acting on the operating control element, in order to close the pressure-regulating valve again after an actuation.

It is preferred if each recess is defined in a closing direction by a return bearing surface, with which the associated head can be brought into bearing contact. The return spring, by way of the tappet, the neck, the head and the return bearing surface, can thereby draw the control piston in the closing direction.

To facilitate assembly and the connection of the tappet to the control piston, each first end portion of the control piston may comprise a lateral passage, through which the head can be inserted into the recess.

In a preferred development the control piston is a stepped piston, which has a first ring surface acting in an opening direction and a second ring surface acting in a closing direction, both of which surfaces are subjected to the pressure of a working connection of the pressure-regulating valve. Here the first ring surface is smaller than the second ring surface. A pressure force acting on the control piston in a closing direction is thereby generated.

In a practically relevant exemplary embodiment of the pilot control unit according to the disclosure four pressure-regulating valves are provided, two pressure-regulating valves in each case being connected by way of their associated working connections to a valve spool of a consumer or a main stage.

It is preferred if each pressure-regulating valve has a control pressure chamber and a tank pressure chamber and a working pressure chamber arranged between them, multiple control pressure chambers being connected to a common control pressure connection of the pilot control unit and multiple tank pressure chambers being connected to a common tank connection of the pilot control unit.

For pressure balancing it is preferred if each control piston comprises a longitudinal bore, a chamber arranged between the housing and a second end portion of the control piston remote from the respective tappet being connected to the tank pressure chamber by way of the longitudinal bore and by way of the passage.

In a practically relevant exemplary embodiment the actuating device has a joystick. If the hydraulic pilot control unit according to the disclosure is arranged in an excavator, excavator-loader, telescoping loader, wheeled loader, compact loader or crane, the noise reduction achieved through the reduction in oscillations is particularly advantageous for a driver or operator.

BRIEF DESCRIPTION OF THE DRAWINGS

An exemplary embodiment of the disclosure is described in detail below with reference to the figures, of which.

DETAILED DESCRIPTION

Figure 1:
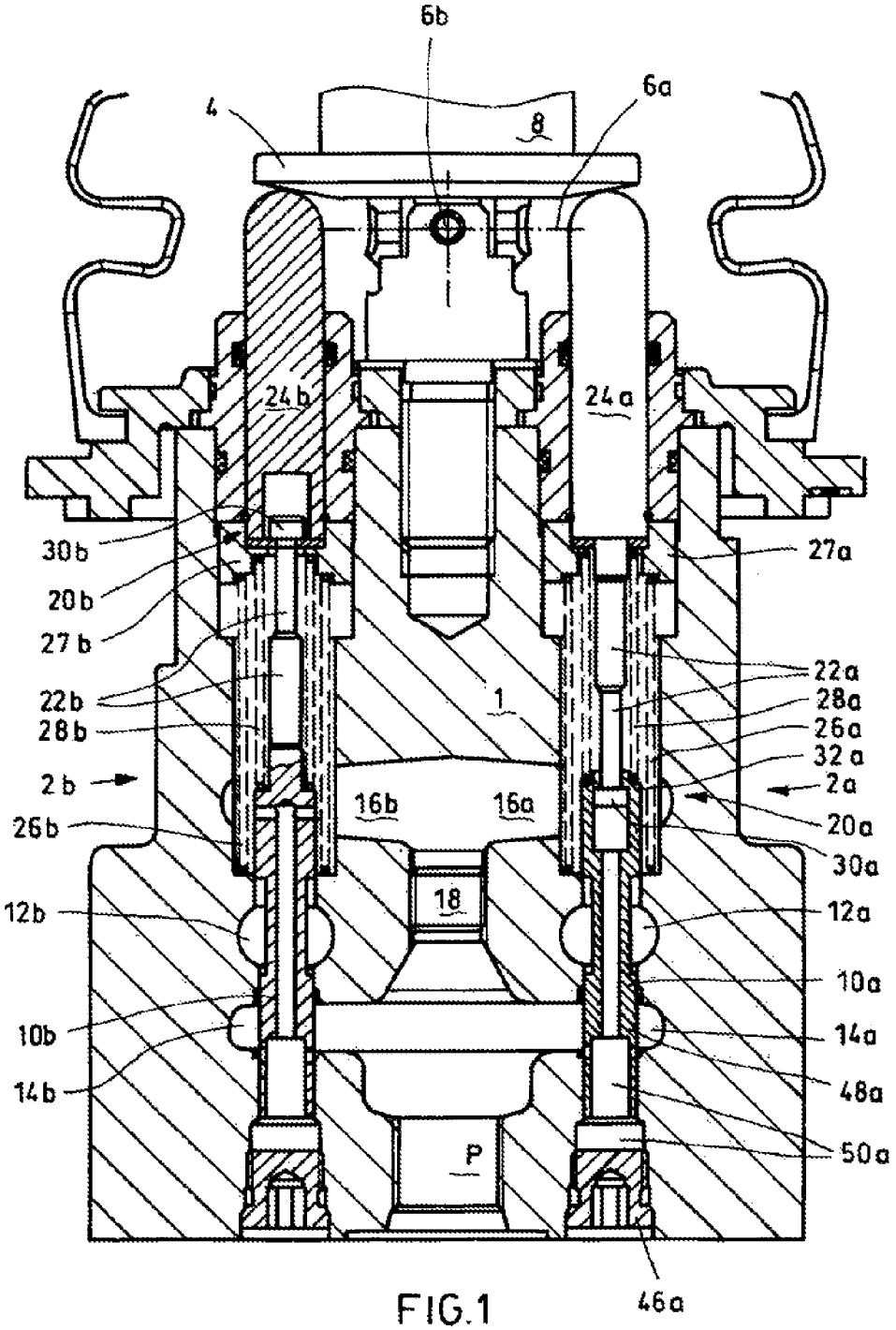
FIG. 1 shows a substantial detail of an exemplary embodiment of a hydraulic pilot control unit according to the disclosure in lateral section, a pressure-regulating valve according to the state of the art and a pressure-regulating valve according to the disclosure being shown combined.

FIG. 1 shows a substantial detail of an exemplary embodiment of a hydraulic pilot control unit according to the disclosure in lateral section. Four pilot control valves embodied as pressure-regulating valves, of which only two pressure-regulating valves 2*a*, 2*b* are represented in FIG. 1, are arranged in a housing 1. The pressure-regulating valves 2*a*, 2*b* are actuated by a rocking actuation plate 4, which can be inclined about a horizontally running first rocker axis 6*a* (FIG. 1), and in relation to the housing 1 by way of a second rocker axis 6*b*, arranged perpendicularly to the drawing plane. This is done by way of a joystick fixed to the actuation plate 4 above the latter, only a relatively small part 8 of which joystick is shown in FIG. 1. Fitted to this part 8 is a handle, which serves for inclining the actuation plate 4 about the two rocker axes 6.

The two pressure-regulating valves 2*a*, 2*b* are shown in their respective neutral positions, in which a respective control piston 10*a*, 10*b* is arranged in an upper closed position in the housing 1, so that a respective working pressure chamber 12*a*, 12*b* and thereby a working connection (not shown) associated with each of these is not supplied with control pressure. For this purpose a hydraulic fluid connection, running from the central control pressure connection P of the pilot control unit according to the disclosure via the control pressure chambers 14*a*, 14*b* assigned to the respective pressure-regulating valves 2*a*, 2*b*, to the respective working pressure chambers 12*a*, 12*b*, is shut off by the control piston 10*a*, 10*b*.

In the neutral position shown the working pressure chamber 12*a*, 12*b* is connected by control grooves (not shown) of the control piston 10*a*, 10*b* to a respective tank pressure chamber 16*a*, 16*b* and is therefore relieved of pressure. The tank pressure chambers 16*a*, 16*b* are connected to a tank (not shown) by way of a common tank connection (not shown) of the pilot control unit. The tank pressure chambers 16*a*, 16*b* are furthermore isolated from the control pressure chambers 14*a*, 14*b* and thereby from the control pressure connection P by a screw plug or a plug 18.

Each control piston 10*a*, 10*b* is connected by a shear-elastic connection 20*a*, 20*b* and by a neck 22*a*, 22*b* to a tappet 24*a*, 24*b*. The tappet 24*a*, 24*b* is biased upwards into the neutral position by a return spring 26*a*, 26*b* and a ring 27*a*, 27*b* (in FIG. 1). For this purpose the return spring 26*a*, 26*b* is supported against a radial flange of the housing 1. The control piston 10*a*, 10*b* is thereby also drawn into its neutral position against a (in FIG. 1) downwardly directed force of a regulating spring 28*a*, 28*b*.

In the case of the pressure-regulating valve 2*b* according to the disclosure represented on the right in FIG. 1 the piston is drawn into the neutral position by the neck 22*a*, which is fixed to the tappet 24*a* and attached to the end portion of which, facing the control piston 10*a*, is a head 30*a* formed by a radial extension. The head 30*a* grips behind a return bearing surface 32*a* of an adjacent first end portion 33*a* of the control piston 10*a*.

Figures 2A, 2B:
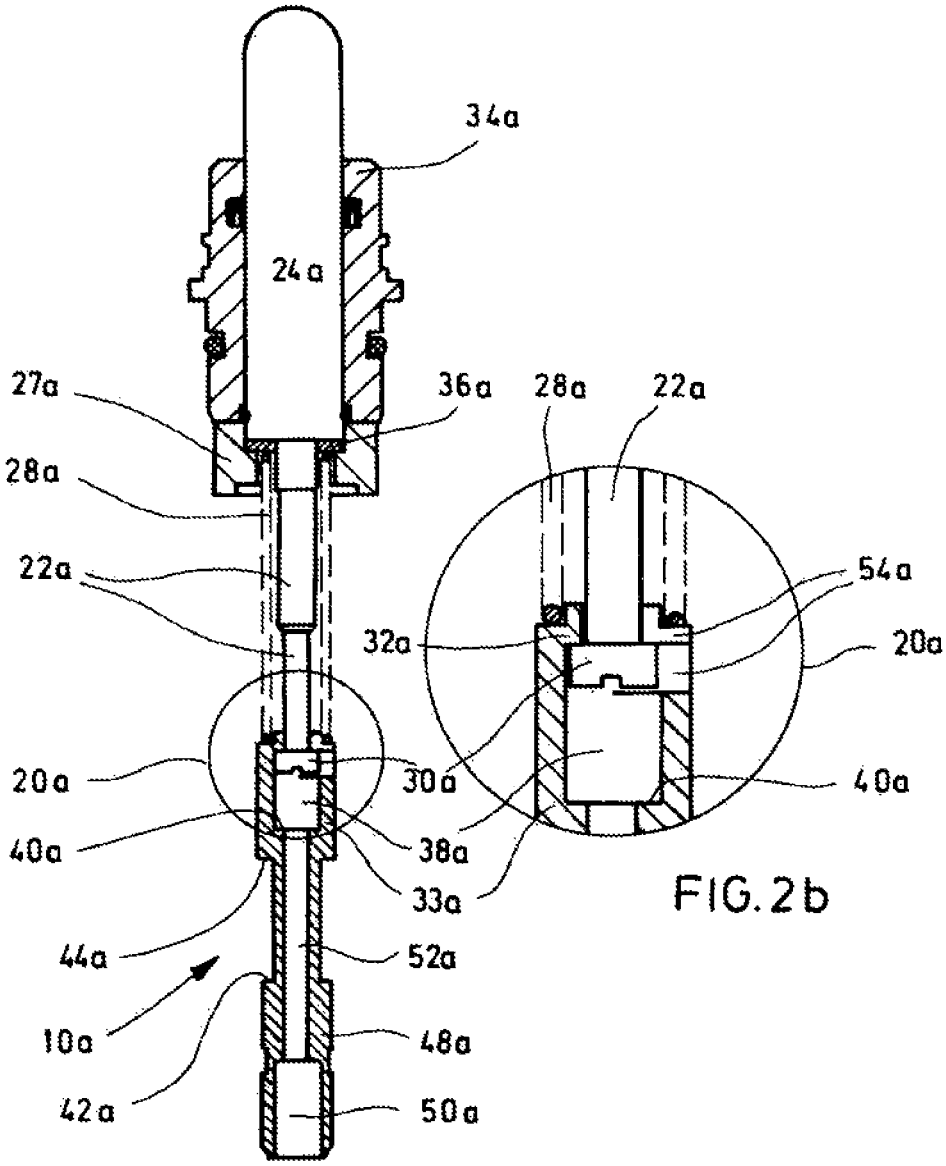
FIG. 2*a* shows an enlarged detail of the exemplary embodiment according to the disclosure in FIG. 1 in a further lateral section.
FIG. 2*b* shows a detail enlargement of the shear-elastic connection in FIG. 2*a*.

FIG. 2*a* shows an enlarged detail of the pressure-regulating valve 2*a* according to the disclosure in a further lateral section, which is set at 90 degrees to the section in FIG. 1. Here the tappet 24*a* with the neck 22*a* and with the head 30*a* is again shown in its neutral position. A sleeve-shaped tappet guide 34*a*, fixed to the housing, is provided for guiding a (in FIG. 2*a*) downwardly directed movement of the tappet 24*a*.

Also shown is the ring 27*a*, by way of which the tappet 24*a* is biased (in FIG. 2*a*) upwards in the closing direction by the return spring 26*a* (not shown in FIG. 2*a*).

Arranged concentrically inside the ring 27*a* is a washer 36*a*, on which the regulating spring 28*a* is supported against the tappet 24*a* and in so doing biases the control piston 10*a* in an opening direction. An end-face concentric recess 38*a*, the diameter of which is approximately equal to that of the head 30*a*, is inserted on the first end portion 33*a* of the control piston 10*a*. The recess 38*a* radially is more tightly stepped at an end face of the first end portion 33*a*, so that a return bearing surface 32*a* is formed. In the neutral position shown the head 30*a* bears against the return bearing surface 32*a*.

On its side situated opposite the return bearing surface 32*a* the recess 38*a* has an end face 40*a*, a predefined interval being provided between the head 30*a* and the end face 40*a*. This interval serves to define a length of travel of the tappet 24*a* in an opening direction of the pressure-regulating valve 2*a*, over which—apart from pressure forces—only a force of the regulating spring 28 is operative. In the event of a further opening movement of the tappet 24*a*, the head 30*a* comes into bearing contact with the end face 40*a* and then assists the (in the figures) downwardly directed opening movement of the control piston 10*a*. A jump in pressure at the respective working pressure chamber 12*a* and at the associated working pressure connection is thereby possible at the end of the control range of the hydraulic pilot control unit according to the disclosure.

As the joystick (not shown) pivots back about the second rocker axis 6*b* (cf. FIG. 1) from an assumed inclination to the right, for the reasons described above the tappet 24*a* moves (in the figures) upwards, the head 30*a* coming into bearing contact with the return bearing surface 32*a* and in so doing carrying the control piston 10*a* with it over the return bearing surface 32*a*.

The control piston 10*a* is a stepped piston having two ring surfaces 42*a*, 44*a* (cf. FIG. 2) subjected to the pressure of the working pressure chamber 12*a*, the second ring surface 44*a* acting in the closing direction of the control piston 10*a* being larger than the first ring surface 42*a* acting in the opening direction.

The first control edge assigned to the first ring surface 42*a* controls the hydraulic fluid connection from the control pressure chamber 14*a* to the working pressure chamber 12*a*, whilst the second control edge assigned to the second ring surface 44*a* controls the hydraulic fluid connection from the working pressure chamber 12*a* to the tank pressure chamber 16*a*. Here a (comparatively small) cross section between the working pressure chamber 12*a* and the tank pressure chamber 16*a* is opened also in the neutral position.

FIG. 1 shows a sealing plug 46*a*, which is screwed in the housing 1 and which together with a second end portion 48*a* of the control piston 10*a* defines a chamber 50*a*.

FIG. 2*a* shows that the chamber 50*a* is connected by way of a longitudinal bore 52*a* to the recess 38*a*.

FIG. 2*b* shows a detail enlargement of the shear-elastic connection 20*a* in a sectional view according to FIG. 2*a*. Here a radial passage 54*a* is provided laterally on the first end portion 33*a* of the control piston 10*a*. The chamber 50*a* is thereby connected to the tank pressure chamber 16*a* by way of the longitudinal bore 52*a*, the recess 38*a* and the lateral passage 54*a* (cf. FIG. 1) and is therefore relieved.

FIG. 2*a* shows the passage 54*a*, which is formed partly in the return bearing surface 32*a* and partly in the area of the recess 38*a*. When assembling or putting the tappet 24*a* together with the control piston 10*a*, the passage 54*a* allows the head 30*a* to be pushed radially into the recess 38*a*.

FIG. 1 provides an illustration through a comparison of the exemplary embodiment of the pressure-regulating valve 2*a* represented on the right (in the figure) with an example of a pressure-regulating valve 2*b* according to the state of the art represented on the left (in the figure). The neck 22*b* and the head 30*b*, which according to the state of the art are fixed to the control piston 10*b*, are according to the disclosure separated therefrom and are associated with the tappet 24*a*. The volume and hence the mass of the tappet 10*a* according to the disclosure are thereby significantly reduced compared to the tappet 10*b*. Tests have confirmed that this reduction in the mass leads to a distinctly reduced inducement of oscillations of the control piston 10*a* and thereby of the hydraulic pilot control unit according to the disclosure.

It has further emerged from tests that a hydraulic pilot control unit, in which the necks of its pressure-regulating valves are not fixed to the tappet in accordance with the disclosure, but the necks of which are fixed to the respective control piston as in the state of the art, likewise exhibits a good oscillation damping if the control pistons are produced from a lighter material. Such materials include, in particular, aluminum and plastic.

The disclosure discloses a hydraulic pilot control unit, which comprises at least one pressure-regulating valve, which can be controlled by way of an actuating device and which in turn comprises a control piston connected to a tappet by way of a neck. Here the tappet has a resilient operative connection to the actuating device. According to the disclosure the neck is fixed to the tappet. This serves to reduce the mass of the control piston susceptible to oscillations, in comparison with the state of the art.

The invention claimed is:

1. A hydraulic pilot control unit comprising:

at least one pressure-regulating valve, which can be controlled by way of an actuating device and which includes a control piston connected to a tappet by way of a neck, wherein the tappet is operatively connected to the actuating device, and wherein the neck is fixed to the tappet, wherein the tappet of each pressure-regulating valve and the associated control piston can be displaced by the actuating device in an opening direction of the control piston, and wherein a shear-elastic connection is provided between the neck of each pressure-regulating valve and the associated control piston, said shear-elastic connection including;

a regulating spring, which is supported against the tappet and which biases the control piston in an opening direction, and a head, which is fixed to an end portion of the neck and is inserted into a recess formed on a first end portion of the control piston, and is displaceable therein in an opening direction.

2. The hydraulic pilot control unit as claimed in claim 1, wherein each control piston is composed substantially of aluminum or plastic.

3. The hydraulic pilot control unit as claimed in claim 1, wherein each head can be brought into bearing contact with an end face of the recess when the associated tappet is displaced in an opening direction.

4. The hydraulic pilot control unit as claimed in claim 1, wherein each pressure-regulating valve has a return spring, which is supported against a housing of the associated pressure-regulating valve or a housing of the pilot control unit, and which biases the tappet in a closing direction.

5. The hydraulic pilot control unit as claimed in claim 1, wherein each recess is defined in a closing direction by a return bearing surface, with which the associated head can be brought into bearing contact.

6. The hydraulic pilot control unit as claimed in claim 1, wherein each first end portion of the control piston comprises a lateral passage, through which the head can be inserted into the recess.

7. The hydraulic pilot control unit as claimed in claim 1, wherein:

each pressure-regulating valve has a control pressure chamber and a tank pressure chamber and a working pressure chamber arranged between them, and multiple control pressure chambers are connected to a control pressure connection of the pilot control unit and multiple tank pressure chambers are connected to a tank connection of the pilot control unit.

8. The hydraulic pilot control unit as claimed in claim 1, wherein the actuating device has a joystick of an excavator, excavator-loader, telescoping loader, wheeled loader, compact loader or crane.

9. A hydraulic pilot control unit comprising:

at least one pressure-regulating valve, which can be controlled by way of an actuating device and which comprises a control piston connected to a tappet by way of a neck, wherein the tappet is operatively connected to the actuating device, and wherein the neck is fixed to the tappet, wherein each pressure-regulating valve has a return spring, which is supported against a housing of the associated pressure-regulating valve or a housing of the pilot control unit, and which biases the tappet in a closing direction, wherein the control piston is a stepped piston, which has a first ring surface acting in an opening direction and a second ring surface acting in a closing direction, both of which surfaces are subjected to the pressure of a working connection of the associated pressure-regulating valve, and wherein the first ring surface is smaller than the second ring surface.

10. The hydraulic pilot control unit as claimed in claim 9, wherein:

four pressure-regulating valves are provided, two of the four pressure-regulating valves are connected by way of their associated working connections to a valve spool of a consumer, and another two of the four pressure-regulating valves are connected by way of their associated working connections to a valve spool of another consumer.

11. A hydraulic pilot control unit comprising:

at least one pressure-regulating valve, which can be controlled by way of an actuating device and which comprises a control piston connected to a tappet by way of a neck, wherein the tappet is operatively connected to the actuating device, and wherein the neck is fixed to the tappet, wherein each pressure-regulating valve has a return spring, which is supported against a housing of the associated pressure-regulating valve or a housing of the pilot control unit, and which biases the tappet in a closing direction, wherein each control piston comprises a longitudinal bore, and wherein a chamber arranged between the housing and a second end portion of the control piston remote from the respective tappet is connected to the tank pressure chamber by way of the longitudinal bore and by way of the passage.

* * * * *